United States Patent [19]

Haug

[11] Patent Number: 4,574,825

[45] Date of Patent: Mar. 11, 1986

[54] TANK CLEANING APPARATUS

[75] Inventor: Josef Haug, Rangendingen, Fed. Rep. of Germany

[73] Assignee: Uraca Pumpenfabrik GmbH & Co. KG, Bad Urach, Fed. Rep. of Germany

[21] Appl. No.: 583,389

[22] Filed: Feb. 24, 1984

[30] Foreign Application Priority Data

Mar. 5, 1983 [DE] Fed. Rep. of Germany ... 8306381[U]

[51] Int. Cl.[4] ..... B08B 3/02; B08B 9/08

[52] U.S. Cl. ..... 134/167 R; 118/306; 118/317; 239/184; 239/227

[58] Field of Search ..... 134/157, 166 R, 167 R, 134/172, 177, 180, 181, 187, 198, 200, 168 R, 169 R; 118/306, 317; 239/184, 227; 15/246.5; 141/231, 232, 284

[56] References Cited

U.S. PATENT DOCUMENTS

| | | | |
|---|---|---|---|
| 1,693,885 | 12/1928 | Butterworth | 134/168 R |
| 3,645,452 | 2/1972 | Stoeckel et al. | 134/168 R X |
| 4,163,455 | 8/1979 | Hebert et al. | 134/167 R |
| 4,219,976 | 9/1980 | Burack et al. | 134/167 R X |
| 4,220,170 | 9/1980 | Hebert et al. | 134/167 R |

FOREIGN PATENT DOCUMENTS

| | | | |
|---|---|---|---|
| 1079667 | 4/1960 | Fed. Rep. of Germany | 134/167 R |
| 3114307 | 10/1982 | Fed. Rep. of Germany | 134/172 |
| 511564 | 8/1939 | United Kingdom | 118/317 |
| 486805 | 10/1975 | U.S.S.R. | 118/317 |

*Primary Examiner*—Philip R. Coe

*Attorney, Agent, or Firm*—Barnes & Thornburg

[57] ABSTRACT

Tank cleaning apparatus is disclosed for cleaning the inside of large railroad car tanks and the like. A sprayhead carrying one or more spray nozzles is mounted on a holding bar which includes a C-shaped semi-circular section and which is mounted on a carrier frame at the outside of the tank for pivotal movement about an axle through the center of curvature of the C-shaped section. The sprayhead is mounted at an end part of the holding bar which extends radially outwardly with respect to the C-shaped section in such a manner that in one end position of the holding bar the sprayhead means is aligned with the center axis of a tank manhole opening and that in the other end position is disposed adjacent the inside end surface of the tank being cleaned. The carrier frame is rotatably mounted at the manhole to accommodate rotation for cleaning respective opposite ends of the tank.

27 Claims, 2 Drawing Figures

TANK CLEANING APPARATUS

BACKGROUND AND SUMMARY OF THE INVENTION

The invention relates to cleaning apparatus for cleaning the inside of large tanks and the like, especially for cleaning railroad tank cars, such apparatus including a sprayhead which rotates and simulataneously sprays streams of cleaning liquid under pressure, including a liquid detergent or soap. The sprayhead can be brought into several different operational positions close to and laterally of the axis of a tank opening/manhole by mounting the same on a curved holding bar extending through the tank manhole, the holding bar being supported by a holding device mounted at the manhole.

The cleaning of railroad tank cars carrying a large tank is made quite often difficult in that the tank has usually only one wide opening or manhole at the top thereof with the inside end faces of the tank being at great distances from the opening. This makes the thorough cleaning from the opening by means of spray cleaning devices almost impossible.

German published examined patent application (DE-ASS) No. 10/79/667 describes an arrangement of the above-mentioned kind, however, the holding device is a plate attachable to the tank manhole featuring a rotatable ball joint which permits slidable guiding of a knee-shaped holding bar. This arrangement allows insertion of the holding bar carrying the sprayhead at one end in the areas of the tank laterally of the opening while sliding and pivoting the other end protruding from the tank. To securely position the sprayhead holding bar, the end carrying the sprayhead is supported by the upper edges of wash plates and the like. This means that due to reasons of stability, no position at large distances from the opening are effectively reachable with this sprayhead arrangement.

Therefore, it is an object of this invention to provide a cleaning device which allows, based on its stability, controlled movement of the tank cleaning sprayhead to large distances from the tank opening.

The invention overcomes the above mentioned disadvantages of the prior art by providing a sprayhead carrier featuring an essentially C-shaped holding bar which is slidably guided over a curved, fixed path, so as to extend at an angle to the manhole axis (centerline extending vertically through the manhole opening). The carrier is also attached to a base by fixing or clamping to the tank manhole rim at the side facing away from the tank in a manner so that the carrier can be rotatably adjusted with respect to the axis of the manhole opening.

Since the holding bar is only movable relative to the carrier, the same can be rather advantageously simply designed with a very stable construction. The rotatability of the sprayhead carrier with respect to the tank opening axis is assured by the rotatable arrangement of the carrier at the base, while being capable of absorbing heavy loads.

The sprayhead, which moves with the holding bar along a well-defined unchangeable track with regards to the carrier, is adjustably positionable with respect to the carrier in dependence only upon the degree of movement of the holding bar with respect to the carrier.

The curved track, which extends diagonally to the verticle axis of the tank opening in the area of the tank opening, permits the sprayhead to reach positions far away from the tank opening without the sprayhead coming too close in distance to the upper or lower inside walls of the tank.

In accordance with an especially preferred embodiment of the invention, the end of the holding bar carrying the sprayhead is angled off radially outwardly with respect to the C-shaped part of the holding bar in such a manner that when the holding bar is in position with the sprayhead closest to the tank opening the angled off end part carrying the sprayhead extends along the vertical axis of the tank opening. In this end position, the tank sprayhead is simply insertable into the tank opening and the base can be set onto the rim of the tank opening by lowering the entire cleaning device from above with verticle insertion of the sprayhead through the tank opening. In a likewise simple fashion the cleaning device is removable from the tank opening.

The guiding of the holding bar is assured in a simple design in that the holding bar, while slidably guided between track elements in the area of the tank opening, is connected with a pivot arm of the carrier at the end of the holding bar facing away from the sprayhead. This pivot arm is pivotably supported at a horizontal axle extending through the center of curvature of the C-shaped part of the holding bar. Guide rollers are advantageously used as guide elements.

If need be, the holding bar could carry another part of guide elements or rollers disposed above the guide rollers in the region of the tank opening, which rollers are disposed at both sides of the plane of the curved track/path for the holding bar.

While it is the primary function of the pivot arm to guide the holding bar, the pivot arm can also serve to move or position the bar on its curved path when connected to a pivot arm actuator. Further, the pivot arm is advantageously designed to serve as a support for carrying tubes or pipes which deliver the spray material (soap, detergent) via a pressure valve through the holding bar to the sprayhead. Such spray material pressure connection is advantageously extended through the holding bar, constructed with a pipe like configuration for this purpose.

Further objects, features, and advantages of the present invention will become more apparent from the following description when taken with the accompanying drawings which show, for purposes of illustration only, an embodiment in accordance with the present invention.

DETAILED DESCRIPTION OF THE DRAWINGS

Figure 1:
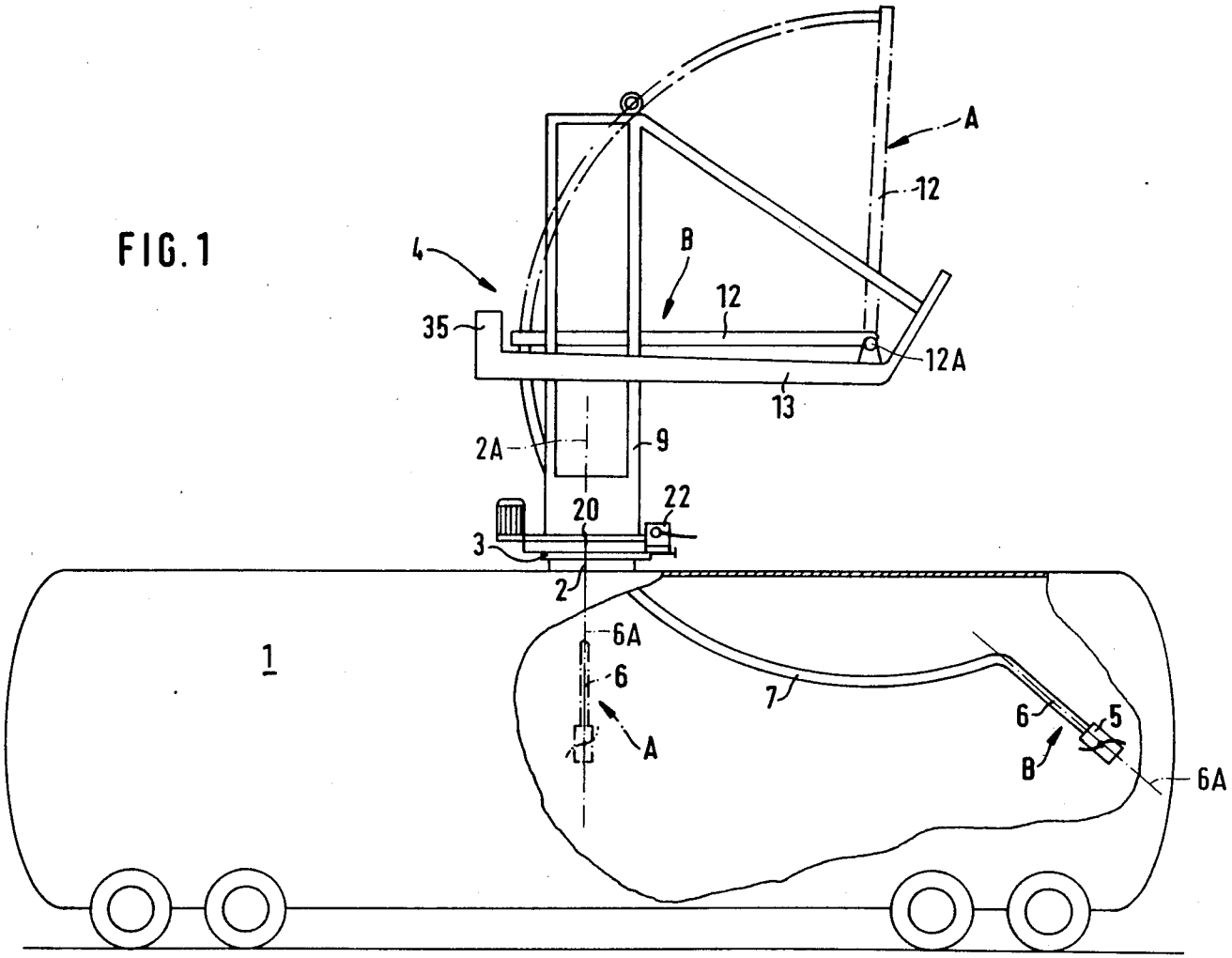
FIG. 1 is a schematic side view of a cleaning device constructed in accordance with a preferred embodiment of the invention mounted in an in use position at a railroad tank car.

A horizontally positioned tank 1 of a large rail car, approximately 12 meters long, exhibits a manhole opening 2 on its top having a flange-like collar 3. The verticle center line or axis 2A of manhole 2 extends vertically through the center of manhole 2.

A cleaning device 4 is mounted at the manhole 2, which cleaning device allows the insertion of a tank cleaning sprayhead 5 into various different positions below and laterally of the manhole 2.

The tank sprayhead 5 is attached to an end part 6 of an otherwise C-shaped holding bar or tube 7. The housing of sprayhead 5 is rotatable with respect to the axis 6A of the end part 6. The sprayhead 5 has at least one rotor 8 featuring spray nozzles or diffusers, rotor(s) 8 being rotatably mounted for rotation about an axis which is perpendicular to the axis 6A of end part 6 mounted at the housing of the tank sprayhead 5.

The holding bar or pipe 7 is slidably guided and supported at a carrier 9 of the cleaning device in such a manner that it is movable from one end position A shown in FIG. 1, wherein the end part 6 extends with its axis 6A coaxial to axis 2A of the manhole 2, to the other end position B over a curved path extending along the C-shape of the holding pipe 7. In end position B, the sprayhead 5 is closely adjacent one of the inside end faces of tank 1.

Track rollers 10 are provided at the carrier 9 in the area of the tank opening or manhole 2 for guiding the holding pipe 7. Track rollers 10 are not only disposed at the outside and inside of the curve of the C-shaped section of the holding pipe 7, they are also disposed to support the holding pipe 7 at both sides of the verticle plane of the holding pipe 7. Other guide rollers 11 are arranged above the guide rollers 10 at the carrier 9, which rollers 11 are simply attached at both sides of the vertical plane of the holding pipe 7. The end of the holding pipe 7 facing away from the sprayhead 5 is connected with a pivot arm 12 which is pivotably mounted by means of a horizontal axle 12A at a bracket arm 13 of the carrier 9 at the center of curvature of the C-shaped section of the holding pipe 7. Axle 12A extends perpendicularly to the verticle plane of the holding pipe 7. The pivot arm 12 secures that end of the holding pipe 7 which is fixedly attached thereto against movements in the direction of its pivot axle. Pivot arm 12 also serves to accommodate adjusting movements of the holding pipe 7 between its end positions A and B.

For accommodating movement of holding pipe 7, the pivot arm 12 is provided with a motor 14 arranged as a pivot actuator at the carrier 9; said motor 14 drivingly operating a chain 15 which runs over a chain wheel 16 controlled by the motor 14 and around tension rollers 17. Chain 15 is attached with its ends 15' and 15'' to the pivot arm 12 at a radial distance from its pivot axle 12A. The tension rollers 17' and 17'' guiding the ends 15', 15'' of chain 15, respectively, have the same distance from the pivot axle 12A of pivot arm 12.

Figure 2:
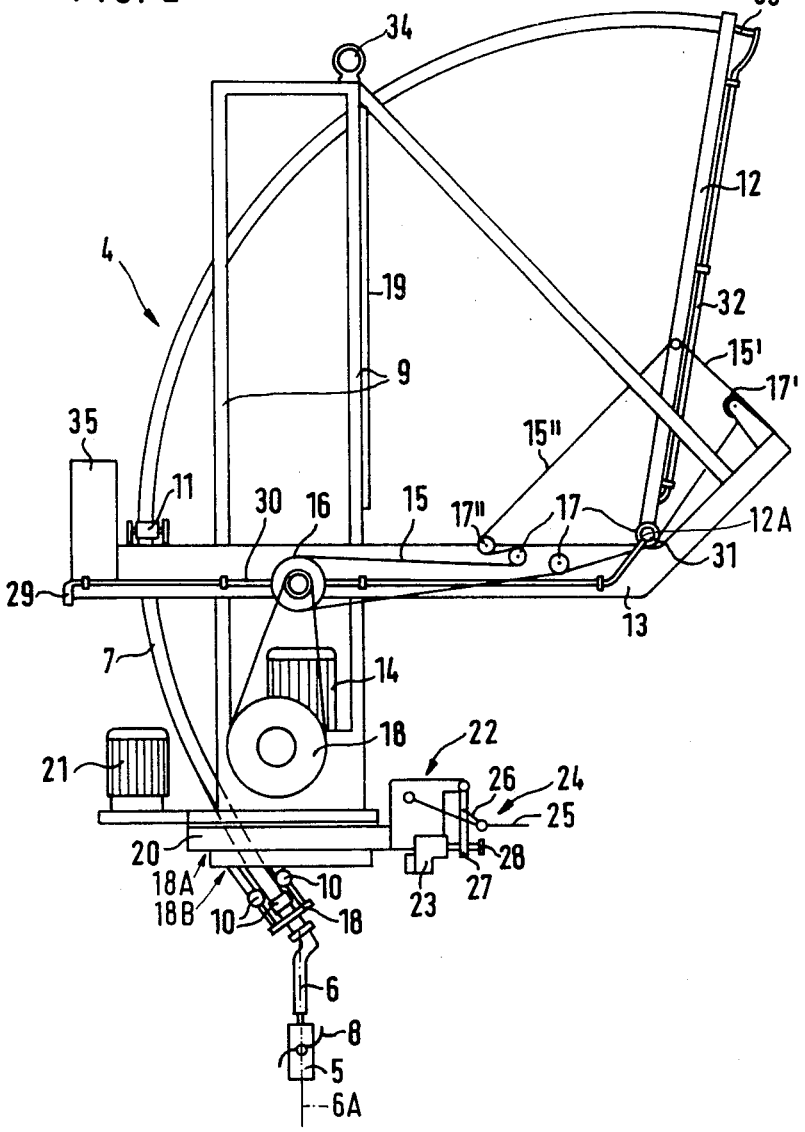
FIG. 2 is an enlarged schematic detailed view of the cleaning device depicted in FIG. 1.

With the chain drive arrangement of FIG. 2, if end 15' of chain 15 is shorteneed, the pivot arm 12 pivots clockwise, and if the end 15'' of chain 15 is shortened, counter-clockwise pivoting of pivot arm 12 occurs. An electronic switch device 18 limits or adjusts the pivot movement in the clockwise direction of pivoting of pivot arm 12. In certain preferred arrangements respective abutments 18A at the holding pipe 7 and 18B at the carrier frame adjacent the opening 2 limit the outward movement of holding pipe 7. The pivot range of pivot arm 12 in the counter-clockwise direction is restricted by means of guide rollers 11 or their bearing parts, which act together with the pivot arm 12 as abutments.

Verticle guide tracks 19 are arranged at carrier 19, which guide tracks act together with pivot arm 12 to secure the same while downwardly extended against swinging movements in the direction of its pivot axle (against lateral swinging into and out of the plane of the illustration of FIG. 2).

In order to move the tank cleaning sprayhead 5 also in a direction towards the other inside end face of tank 1 shown on the left side in FIG. 1, carrier 9 is rotably supported for movement about axis 2A on collar 3 at the top of manhole 2. The carrier 9 is movable (rotatable) at any time into the opposite position from that shown in FIG. 1, if the holding pipe 7 is first moved to its end position A and the clamping arrangement described below is appropriately loosened. A motor 21 is arranged for rotating the carrier 9 on the base part 20. Clamping jaw devices 22 (one shown) serve to tighten the base part 20 on the collar 3 of manhole 2, which devices each provide one clamping jaw 23 movable from the outside against collar 3. A knee lever mechanism 24 serves to operate the clamping jaw 23, with a first lever 25 manually adjusted which is pivotably positioned at base part 20. This first lever 25 is pivotally connected via a bar 26 with a second lever 27 in a knee-type manner which likewise pivotably carried at the base element 20. The free end of the second lever 27 is coupled by means of an adjustable spindle 28 to the clamping jaw 23 in such a manner, that the second lever 27 while pivoted clockwise during downward pivot of the first lever 25, attempts to move the clamping jaw 23 by means of spindle 28 against collar 3. Said clamping jaw 23 is removed from collar 3 when the first lever 25 is pivoted upwards. Spindle 28 enables a preadjustment of said individual clamping jaw 23 with respect to the diameter of collar 3, while the actual tension clamping results as the first lever 25 is operated.

Connection 29 is provided to supply the spray material to the tank sprayhead 5 over connecting supply hoses or the like, which connection 20 is arranged a relatively small distance from the manhole opening axis 2A. Thus connection 29 extends only a relatively short distance when cleaning device 4 or carrier 9 is pivoted or rotated around said axis 2A, thereby avoiding an intertwisting of the supply hose or the like around top-mounted parts of the tank or the like. A pipe 30 extends from connector 29 to a swivel joint element 31 which connects the pipe 30 with a pipe part arranged at the pivot arm 12 and rotatable only in its joint lugs at the base part 13. The end of this pipe part facing away from the swivel joint element 31 is connected to a pipe 32 arranged at pivot arm 12, said pipe 32 further being connected to a hose 33 extending within holding pipe 7 and leading to the spray diffuser connector for the tank sprayhead 5.

To attach the cleaning device 4 at tank opening 2 or to remove said cleaning device 4 from said opening 2, a crane or similar device which is not described in detail is provided which is detachably connectible to a holding ring 34 at the upper end of carrier 9. A counter weight 35 insures the verticle positioning of cleaning device 4 as shown in FIG. 2 when holding pipe 7 is either in an uplifted hovering state or in the end position A.

Although the present invention has been described and illustrated in detail, it is to be clearly understood that the same is by way of illustration and example only, and is not to be taken by way of limitation. The spirit and scope of the present invention are to be limited only by the terms of the appended claims.

I claim:

1. Apparatus for cleaning the inside of a large railroad car tank or the like having a tank access opening, said apparatus comprising:

cleaning sprayhead means including spray nozzle means for accommodating spraying of cleaning fluid against the inside wall surfaces of a tank to be cleaned, holding bar means supportably holding the sprayhead means, and carrier frame means detachably mountable to the tank at the tank access opening, said carrier frame means supportably carrying the holding bar means, and moving means for moving the holding bar means relative to the carrier frame means, wherein said holding bar means includes a C-shaped section and wherein the carrier frame means includes holding bar guide means for supporting and guiding movement of the C-shaped section of the holding bar means along a curved path after said carrier frame means is mounted to said tank with corresponding movement of the sprayhead means to different cleaning positions inside the tank being cleaned.

2. Apparatus according to claim 1, comprising carrier frame mounting means for mounting the carrier frame means for rotational movement with respect to a center axis through the tank access opening of a tank being cleaned.

3. Apparatus according to claim 2, wherein said carrier frame mounting means includes means for mounting the carrier frame means at the top of a tank being cleaned.

4. Apparatus according to claim 2, wherein said holding bar means includes an end portion which holds the sprayhead means, said end portion extending outwardly with respect to the C-shaped section, said holding bar means being configured so that said end portion extends substantially coaxially to the center axis of the tank access opening when the holding bar is disposed at a first end position.

5. Apparatus according to claim 4, wherein the ratio between the radius of curvature of the C-shaped section of the holding bar means and the maximum distance of the sprayhead means from the center axis of the tank access opening when the holding bar means is in said one of its end positions is approximately 5:8.

6. Apparatus according to claim 2, wherein said holding bar guide means includes lower contact elements guidingly engageable with the C-shaped section of the holding bar means in the region of the tank access opening, and wherein the holding bar means has an end portion opposite the sprayhead means, said end portion being connected to a pivot support arm, said pivot support arm being pivotably carried at a horizontal axle disposed at the center of curvature of the C-shaped section.

7. Apparatus according to claim 6, wherein said lower contact elements include first and second guide rollers and said holding bar means has radial inner and outer sides and lateral sides, said first guide rollers engaging said radial inner and outer sides of the holding bar means, said second guide rollers engaging the lateral sides of the holding bar means.

8. Apparatus according to claim 7, wherein said holding bar guide means includes upper contact elements in the form of guide rollers engaging the lateral sides of the holding bar means at positions spaced above the lower contact elements.

9. Apparatus according to claim 6, wherein stop abutment means are disposed at the holding bar guide means below the lower contact elements, said stop abutment means being configured to cooperate with counter stop abutment means on the holding bar means to limit outward movement of the holding bar means.

10. Apparatus according to claim 6, wherein said pivot support arm is coupled by coupling drive means to a motor-driven swivel actuator arranged at the carrier frame means and operable to forcibly adjust the position of the holding bar means.

11. Apparatus according to claim 10, wherein the coupling drive means includes one of a traction rope and a pull chain connected to the pivot support arm means at a distance from the pivot axis thereof.

12. Apparatus according to claim 2, comprising a liquid cleaning means intake connection at the carrier frame means adjacent the tank access opening of a tank being cleaned, and conduit means leading from said intake connection to a pressure pipe, said holding bar means having an end opposite the sprayhead means, said pressure pipe being disposed at the end of the holding bar means which is opposite the sprayhead means, said pressure pipe being connected to the sprayhead means.

13. Apparatus according to claim 12, wherein said holding bar means has an inside, said pressure pipe being disposed on the inside of the holding bar means.

14. Apparatus according to claim 12, including a pivot support arm connected to the holding bar means and a horizontal axle pivotably supporting the pivot support arm, wherein the intake connection is connected to a pipe leading to a position of the horizontal axle pivotally supporting the pivot support arm, said pipe being pivotally connected to said pressure pipe by means of another pipe pivotally connected to said pipe and extending along the pivot support arm said pivot support arm having an end opposite the sprayhead means, said another pipe extending to the end of the pivot support arm opposite the sprayhead means.

15. Apparatus according to claim 2, wherein said carrier frame mounting means includes clamping jaw means, said carrier frame includes a base element, and said tank access opening includes a collar, said clamping jaw means being selectively movably actuated by joint lever means disposed at the base element of the carrier frame means to selectively engage the collar at the tank excess opening.

16. Apparatus according to claim 2, wherein said sprayhead means includes at least one rotatably mounted spray nozzle.

17. Apparatus for cleaning the inside of a large railroad car tank or the like having a tank access opening, said apparatus comprising:

cleaning sprayhead means including spray nozzle means for accommodating spraying of cleaning fluid against the inside wall surfaces of a tank to be cleaned, holding bar means supportably holding the sprayhead means, carrier frame means detachably mountable to the tank at the tank access opening, and moving means for moving the holding bar means relative to the carrier frame means said carrier frame means supportably carrying the holding bar means, said holding bar means including a C-shaped section, said carrier frame means including holding bar guide means for supporting and guiding the movement of the C-shaped section of the holding bar means along a curved path after said carrier frame means is mounted to said tank with corresponding movement of the sprayhead means to different cleaning positions inside the tank being cleaned, carrier frame mounting means for mounting the carrier frame means for rotational movement with respect to a center axis through the tank access opening of a tank being cleaned, said carrier frame mounting means including means for mounting the carrier frame means at the top of a tank being cleaned, wherein said holding bar means includes an end portion which holds the sprayhead means, said end portion extending outwardly with respect to the C-shaped section, said holding bar means being configured so that said end portion extends substantially coaxially to the center axis of the tank access opening when the holding bar is disposed at a first end position, said holding bar guide means including lower contact elements guidingly engagable with the C-shaped section of the holding bar means in the region of the tank access opening, and wherein the holding bar means has an end portion opposite the sprayhead means, said end portion being connected to a pivot support arm, said pivot support arm being pivotably carried at a horizontal axle disposed at the center of curvature of the C-shaped section, said sprayhead means including at least one rotatably mounted spray nozzle.

18. Apparatus according to claim 17, wherein the ratio between the radius of curvature of the C-shaped section of the holding bar means and the maximum distance of the sprayhead means from the center axis of the tank access opening when the holding bar means is in said one of its end position is approximately 5:8.

19. Apparatus according to claim 17, wherein said lower contact elements include first and second guide rollers and said holding bar means has radial inner and outer sides and lateral sides, said first guide rollers engaging said radial inner and outer sides of the holding bar means said second guide rollers engaging the lateral sides of the holding bar means.

20. Apparatus according to claim 17, wherein said holding bar guide means includes upper contact elements in the form of guide rollers engaging the lateral sides of the holding bar means at positions spaced above the lower contact elements.

21. Apparatus according to claim 17, wherein stop abutment means are disposed at the holding bar guide means below the lower contact elements, said stop abutment means being configured to cooperate with counter stop abutment means on the holding bar means to limit outward movement of the holding bar means.

22. Apparatus according to claim 17, wherein said pivot support arm is coupled by coupling drive means to a motor-driven swivel actuator arranged at the carrier frame means and operable to forcibly adjust the position of the holding bar means.

23. Apparatus according to claim 17, wherein the coupling drive means includes one of a traction rope and a pull chain connected to the pivot support arm means at a distance from the pivot axis thereof.

24. Apparatus according to claim 17, comprising a liquid cleaning means intake connection at the carrier frame means adjacent the tank access opening of a tank being cleaned, and conduit means leading from said intake connection to a pressure pipe, said holding bar means having an end opposite the sprayhead means, said pressure pipe being disposed at the end of the holding bar means which is opposite the sprayhead means, said pressure pipe being connected to the sprayhead means.

25. Apparatus according to claim 17, wherein said holding bar means has an inside, said pressure pipe being disposed on the inside of the holding bar means.

26. Apparatus according to claim 17, including a pivot support arm connected to the holding bar means and a horizontal axle pivotally supporting the pivot support arm, wherein the intake connection is connected to a pipe leading to a position of the horizontal axle pivotally supporting the pivot support arm, said pipe being pivotally connected to said pressure pipe by means of another pipe pivotally connected to said pipe and extending along the pivot support arm said pivot support arm having an end opposite the sprayhead means, said another pipe extending to the end of the pivot support arm opposite the sprayhead means.

27. Apparatus according to claim 17, wherein said carrier frame mounting means includes clamping jaw means, said carrier frame includes a base element, and said tank access opening includes a collar, said clamping jaw means being selectively movably actuated by joint lever means disposed at the base element of the carrier frame means to selectively engage the collar at the tank excess opening.

* * * * *